US007780139B2

(12) United States Patent
Markert

(10) Patent No.: US 7,780,139 B2
(45) Date of Patent: Aug. 24, 2010

(54) UMBRELLA SUPPORT SYSTEM

(76) Inventor: Tom Markert, 2760 Boulder Dr., Burnsville, MN (US) 55337

( * ) Notice: Subject to any disclaimer, the term of this patent is extended or adjusted under 35 U.S.C. 154(b) by 75 days.

(21) Appl. No.: 11/240,988

(22) Filed: Sep. 30, 2005

(65) Prior Publication Data

US 2006/0070643 A1 Apr. 6, 2006

Related U.S. Application Data

(60) Provisional application No. 60/615,459, filed on Oct. 1, 2004.

(51) Int. Cl.
*F16M 13/00* (2006.01)

(52) U.S. Cl. ..... 248/523; 248/519; 135/15.1; 135/16

(58) Field of Classification Search ..... 248/519, 248/523, 522, 530, 511, 512; 135/137, 15.1, 135/16, 118, 98, 114; 180/50.12
See application file for complete search history.

(56) References Cited

U.S. PATENT DOCUMENTS

| | | | | |
|---|---|---|---|---|
| 2,945,659 | A * | 7/1960 | McDonald | 52/40 |
| 5,040,251 | A * | 8/1991 | Hanford | 4/496 |
| D321,087 | S | 10/1991 | Fadell | |
| D389,334 | S | 1/1998 | Attridge | |
| 6,113,054 | A | 9/2000 | Ma | |
| 6,202,369 | B1 * | 3/2001 | Partee et al. | 52/165 |
| 6,354,554 | B1 | 3/2002 | Hollenbeck | |
| 6,619,610 | B1 | 9/2003 | Genovese | |
| 7,021,598 | B2 * | 4/2006 | Kao | 248/521 |
| 7,044,064 | B2 * | 5/2006 | Li | 108/50.12 |
| 2005/0189005 | A1 * | 9/2005 | Smith et al. | 135/16 |

* cited by examiner

*Primary Examiner*—A. Joseph Wujciak, III
(74) *Attorney, Agent, or Firm*—Kinney & Lange, P.A.

(57) ABSTRACT

The present invention is a support system that includes a receptacle mountable to a surface, and a base for providing lateral support to a mountable object. The base includes a skirt and a tube for retaining the mountable object. The tube extends through the skirt and is retained in the receptacle.

14 Claims, 9 Drawing Sheets

UMBRELLA SUPPORT SYSTEM

CROSS-REFERENCE TO RELATED APPLICATION(S)

Priority is claimed under U.S. Provisional Patent Application Ser. No. 60/615,459 filed on Oct. 1, 2004, entitled "Umbrella Support System", which is incorporated by reference in its entirety.

BACKGROUND OF THE INVENTION

The present invention relates to a support system for mountable objects, such as umbrellas. In particular, the present invention relates to a support system for providing lateral support to a mountable umbrella.

There are a variety of conventional umbrella supports used to retain an umbrella in an upright position during use. An example of a common conventional umbrella support is a weighted base that connects to an umbrella shaft. Weighted bases function as anchors and retain umbrellas upright against moderate lateral forces, such as moderate winds. However, the weighted bases are generally not fixed to the underlying surfaces and may be moved by high lateral forces. As such, their use in windy situations, such as on boat decks, is limited. Accordingly, there is a need for a support system for an umbrella that is capable of retaining the umbrellas when exposed to high levels of lateral force (e.g., windy conditions).

BRIEF SUMMARY OF THE INVENTION

The present invention is a support system for retaining objects, such as umbrellas, and includes a receptacle mountable to a surface, and a base for providing lateral support to a mountable object. The base includes a skirt and a tube for retaining the mountable object. The tube extends through the skirt and is retained in the receptacle.

DETAILED DESCRIPTION

Figure 1:
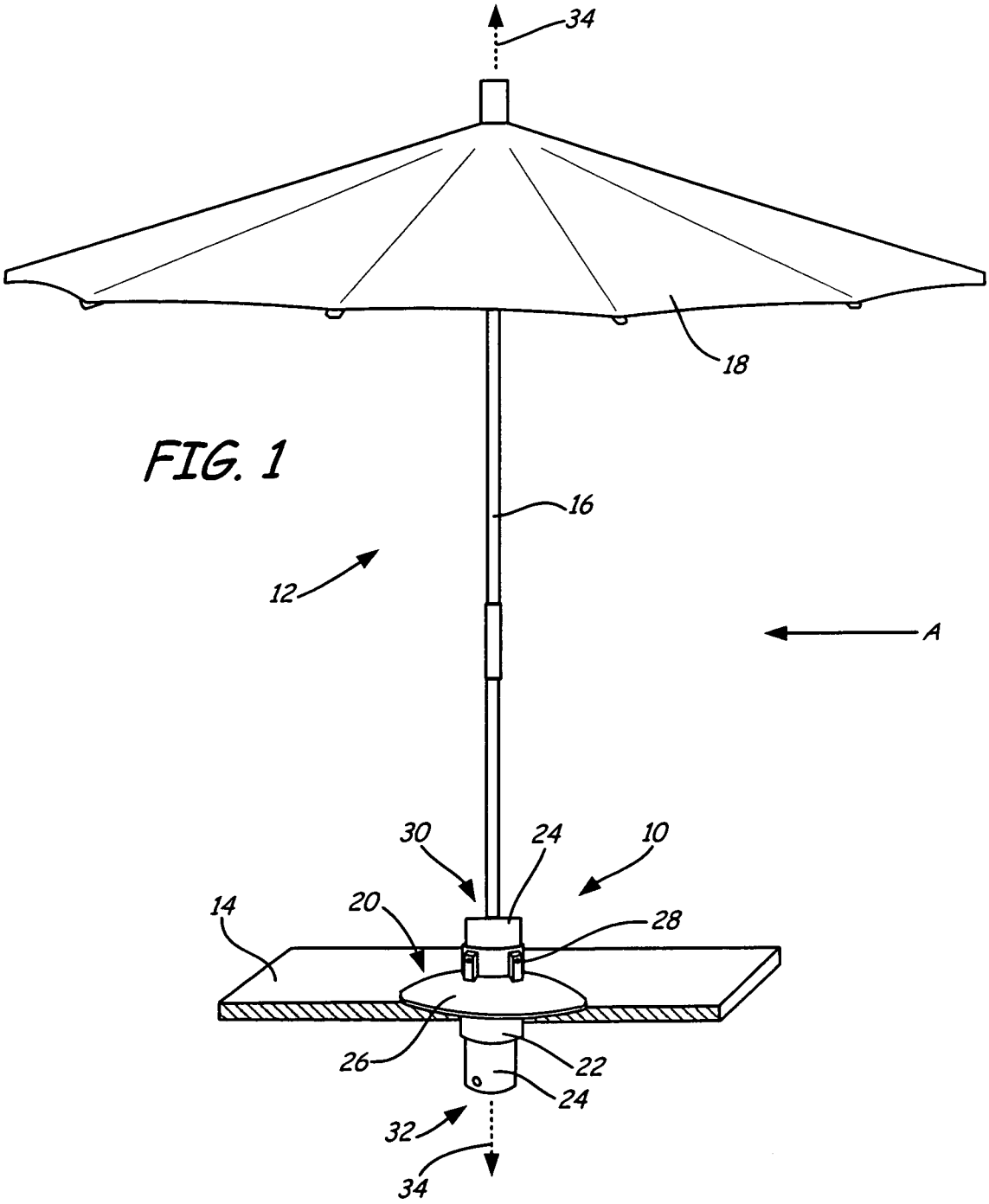
FIG. 1 is a perspective view of the present invention in use.

FIG. 1 is a perspective view of an umbrella support system 10 of the present invention in use with an umbrella 12 and a mounting surface 14. The umbrella support system 10 provides a stable holder for the umbrella 12 and distributes lateral forces applied to the umbrella 12 from a variety of sources, such as wind and people leaning on the umbrella 12. The umbrella 12 is a conventional umbrella and includes a shaft 16 connected to a canopy 18. The mounting surface 14 may be any suitable surface where the umbrella 12 may desirably be placed. Suitable examples of the mounting surface 14 include boat decks (e.g., pontoon boat decks), docks, patios, and residential decks.

The umbrella support system 10 includes a base 20 and a receptacle 22, where the receptacle 22 extends through a hole (not shown) in the mounting surface 14. As discussed below, the base 20 inserts into, and substantially covers the receptacle 22 during use. The base 20 includes a tube 24, a skirt 26, and a collar 28. The tube 24 has a first end 30 and a second end 32, which are oriented along a longitudinal axis 34. For ease of discussion, terms of vertical orientation, such as "above", "below", and the like, are herein referenced relative to a vertical axis parallel to the longitudinal axis 34 in FIG. 1. This is with full understanding that actual orientations may vary depending upon the placement of the umbrella support system 10.

As shown, the tube 24 extends within, and is securely connected to the skirt 26 and the collar 28. Accordingly, the skirt 26 and the collar 28 extend circumferentially around the longitudinal axis 34 of the umbrella support system 10. During use, the first end 30 of the tube 24 is disposed above the mounting surface 14 and the second end 32 of the tube 24 is disposed below the mounting surface 14. The shaft 16 of the umbrella 12 is inserted into the first end 30, and extends within the umbrella support system 10 to the second end 32. As such, during use, a portion of the shaft 16 extends below the mounting surface 14. Preferably, the shaft 16 is securely retained in the umbrella support system 10 during use, and may also be removed from the umbrella support system 10 when not in use.

During use, the base 20 rests on the mounting surface 14. This arrangement allows the umbrella support system 10 to distribute lateral forces applied to the umbrella 12 to the mounting surface 14. When a lateral force is applied to the umbrella 12, such as a force in a direction A, the shaft 16 of the umbrella 12 is generally biased in the same direction. However, because the shaft 16 is supported by the umbrella support system 10, the shaft 16 is capable of resisting a greater amount of lateral force without tipping over (compared to an umbrella shaft that is supported merely with a conventional stand). Moreover, the base 20 distributes a portion of the lateral force applied to the shaft 16 toward the mounting surface 14. This allows the shaft 16 to resist higher levels of lateral force without breaking.

Figure 2:
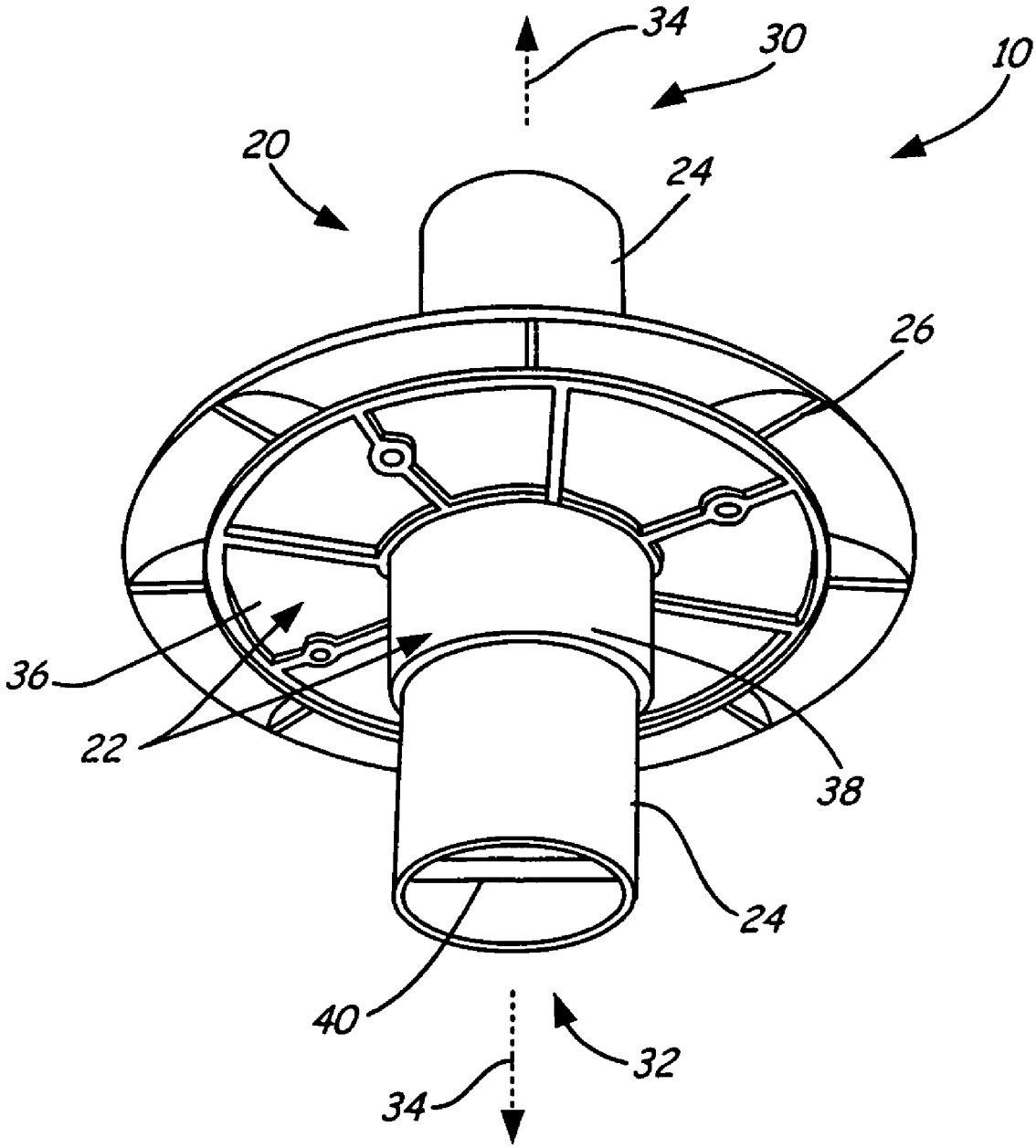
FIG. 2 is a bottom perspective view of the present invention.

FIG. 2 is a bottom perspective view of the umbrella support system 10, further depicting the base 20 and the receptacle 22. As shown, the tube 24 has distal ends at the first end 30 and the second end 32 of the umbrella support system 10. As such, the tube 24 is the portion of the umbrella support system 10 that securely retains the shaft 16 of the umbrella 12. The skirt 26 extends circumferentially around the tube 24, vertically between the first end 30 and the second end 32. The tube 24, the skirt 26, and the collar 28 of the base 20 are preferably securely connected.

The receptacle 22 is disposed below the base 20 and also extends circumferentially around the tube 24. The receptacle 22 includes a flange 36 and a sleeve 38. As discussed in greater detail below, the receptacle 22 is securely mountable to the mounting surface 14 via the flange 36, and the tube 24 of the base 20 is then removably insertable through the flange 36 and the sleeve 38 of the receptacle 22.

The tube 24 also includes a pin 40 that extends diametrically within the tube 24, generally at the second end 32. The pin 40 may be securely connected to the tube 24 in a variety of conventional manners, such as welding, soldering, adhering, and combinations thereof. Alternatively, the pin 40 may be cast or molded as a single, homogenous part with the tube 24. In another alternative embodiment, the pin 40 may be removably insertable through the second end 32 of the tube 24, and secured by conventional techniques.

The pin 40 supports a tip of the shaft 16 when the shaft 16 extends through the tube 24. Without the pin 40, the shaft 16 may extend too far through the tube 24 until the tip contacts a surface below the mounting surface 14. If there is no solid surface below the mounting surface 14 (e.g., a dock), the umbrella 12 would fall through the tube 24 and the mounting surface 14 until the canopy 18 undesirably rests on the mounting surface 14.

In alternative embodiments of the present invention, a variety of techniques for retaining the shaft 16 within the tube 24 may be used, such as sealing the tube 24 at the second end 32. However, preferably, the tube 24 is at least partially open at the second end 32 to allow water that enters the tube 24 from the first end 30 (e.g., rain or splashed water) to pass through the second end 32. Accordingly, the pin 40 simultaneously provides for rapid drainage of water entering the tube 24 and adequately retains the shaft 16. Nonetheless, other similar means may alternatively be used, such as grated plates, orifice-containing plates and mesh screens.

Figure 3:
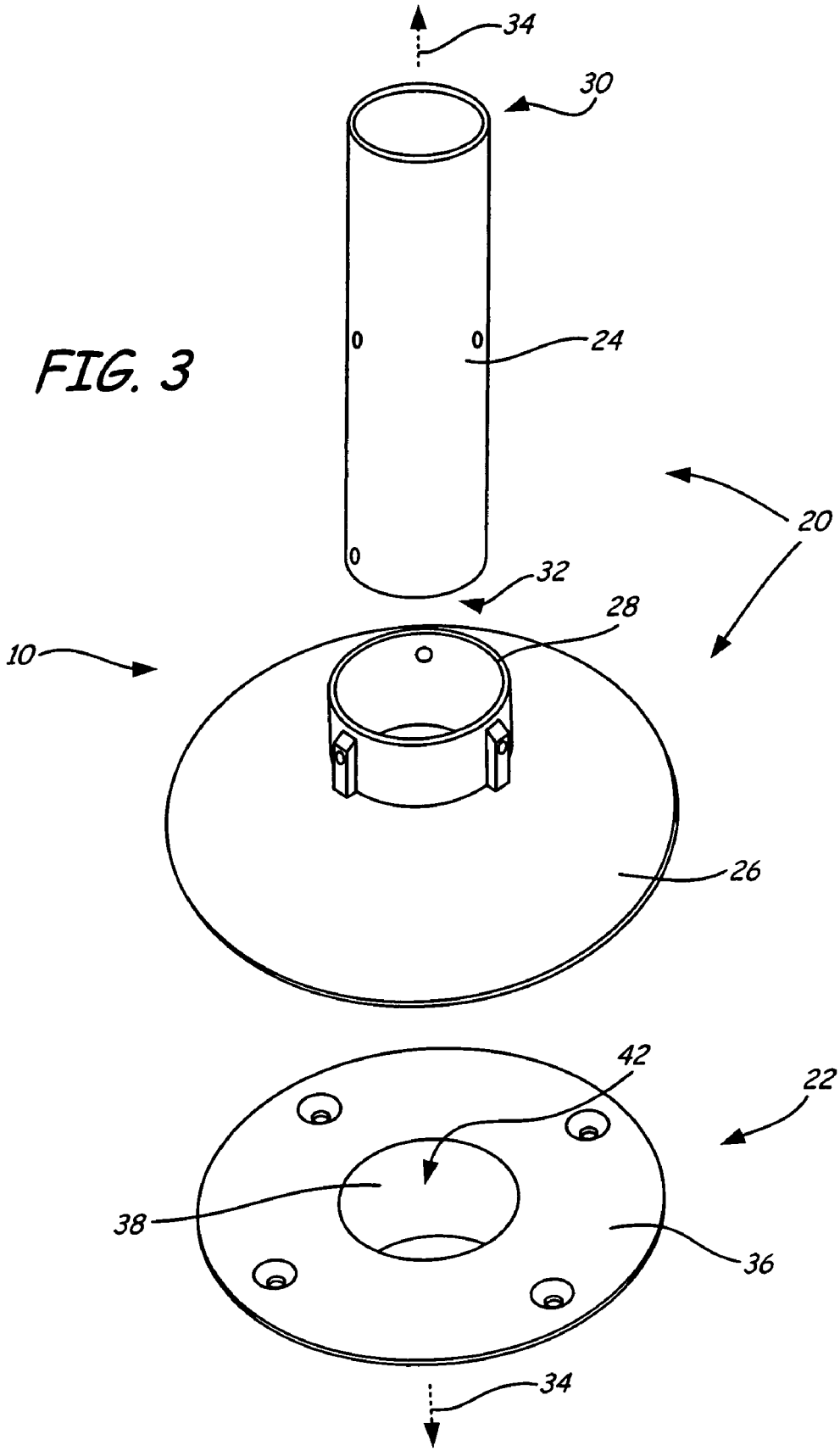
FIG. 3 is an exploded perspective view of the present invention.

FIG. 3 is an exploded perspective view of the umbrella support system 10, depicting the tube 24 and the skirt 26 of the base 20, and the receptacle 22, before the base 20 is inserted into the receptacle 22. As shown in FIG. 3, the tube 24 has not yet been extended through the skirt 26.

Figure 4A:
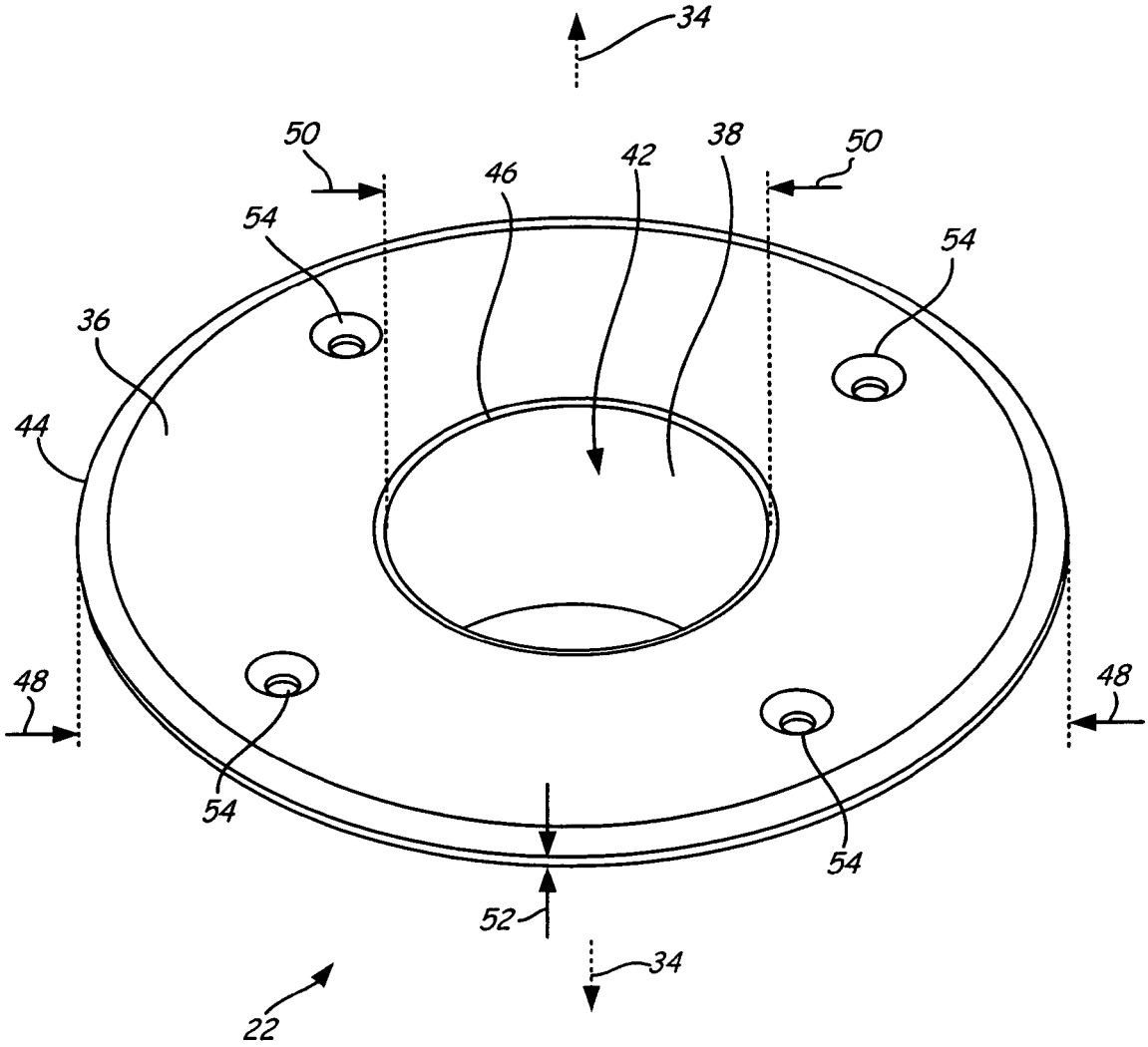
FIG. 4*a* is a top perspective view of a receptacle of the present invention.
Figure 4B:
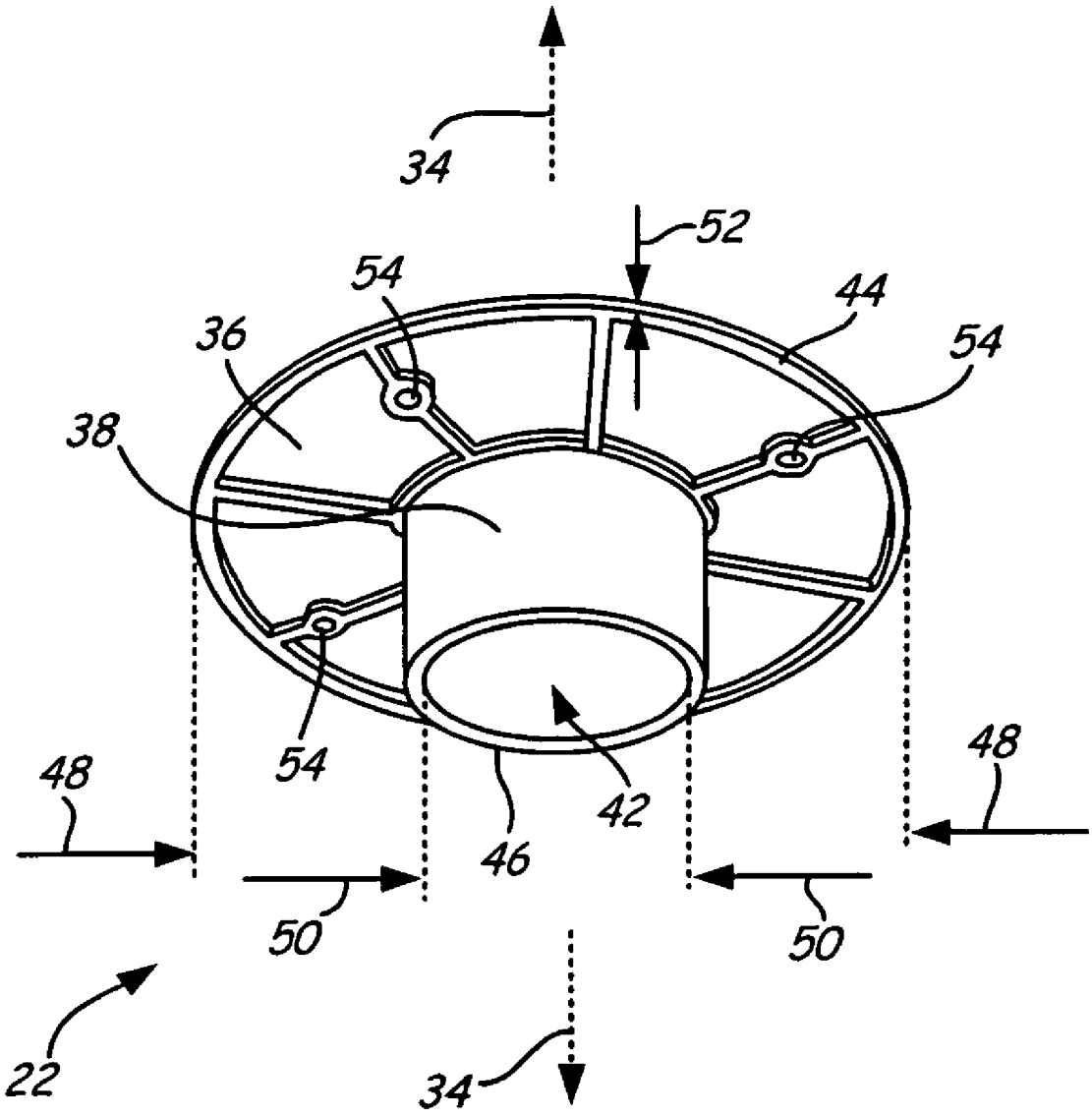
FIG. 4*b* is a bottom perspective view of a receptacle of the present invention.

FIGS. 4*a* and 4*b* are top and bottom perspective views, respectively, of the receptacle 22. During installation and use of the umbrella support system 10, the receptacle 22 is first securely mounted to the mounting surface 14 (not shown). The receptacle 22 includes the flange 36, the sleeve 38, and a receptacle annular passage 42. The flange 36 extends circumferentially around the receptacle annular passage 42. The flange 36 contains an outer edge 44 and inner edge 46, which define an outer diameter 48 and an inner diameter 50, respectively.

Examples of a suitable value for outer diameter 48 range from about 6 to 12 inches, with a particularly suitable outer diameter 48 including about 8.0 inches. Examples of a suitable value for inner diameter 50 range from about 1 to 5 inches, with a particularly suitable inner diameter 50 including about 3.0 inches. The flange 36 also preferably exhibits a thickness 52 in the vertical direction that is relatively small compared to the outer diameter 48. Examples of a suitable value for thickness 52 range from about 0.1 to 0.5 inches, with a particularly suitable thickness 52 including about 0.1 inches.

Preferably, the flange 36 and the sleeve 38 are cast or molded from a die as a single component, but may alternatively be separate parts that are securely connected in a conventional manner (e.g. welding).

The flange 36 also includes mounting bores 54, which are holes that extend through the flange 36 to secure the receptacle 22 to the mounting surface 14 via conventional fasteners (e.g., screws, nails, and bolts). The sleeve 38 also extends circumferentially around the receptacle annular passage 42, starting at the inner edge 46 of the flange 36, and extending downward around the receptacle annular passage 42.

To securely mount the receptacle 22 to the mounting surface 14 (not shown), a hole is first cut into the mounting surface 14. The hole has a diameter at least wide enough to allow the sleeve 38 to extend through. The sleeve 38 is then inserted into the hole of the mounting surface 14 such that the flange 36 is generally flush with the mounting surface 14. The receptacle 22 is then securely fastened to the mounting surface 14 via fasteners inserted through the mounting bores 54 in the flange 36. As such, the receptacle 22 is desirably a permanent fixture in the mounting surface 14.

Figure 5:
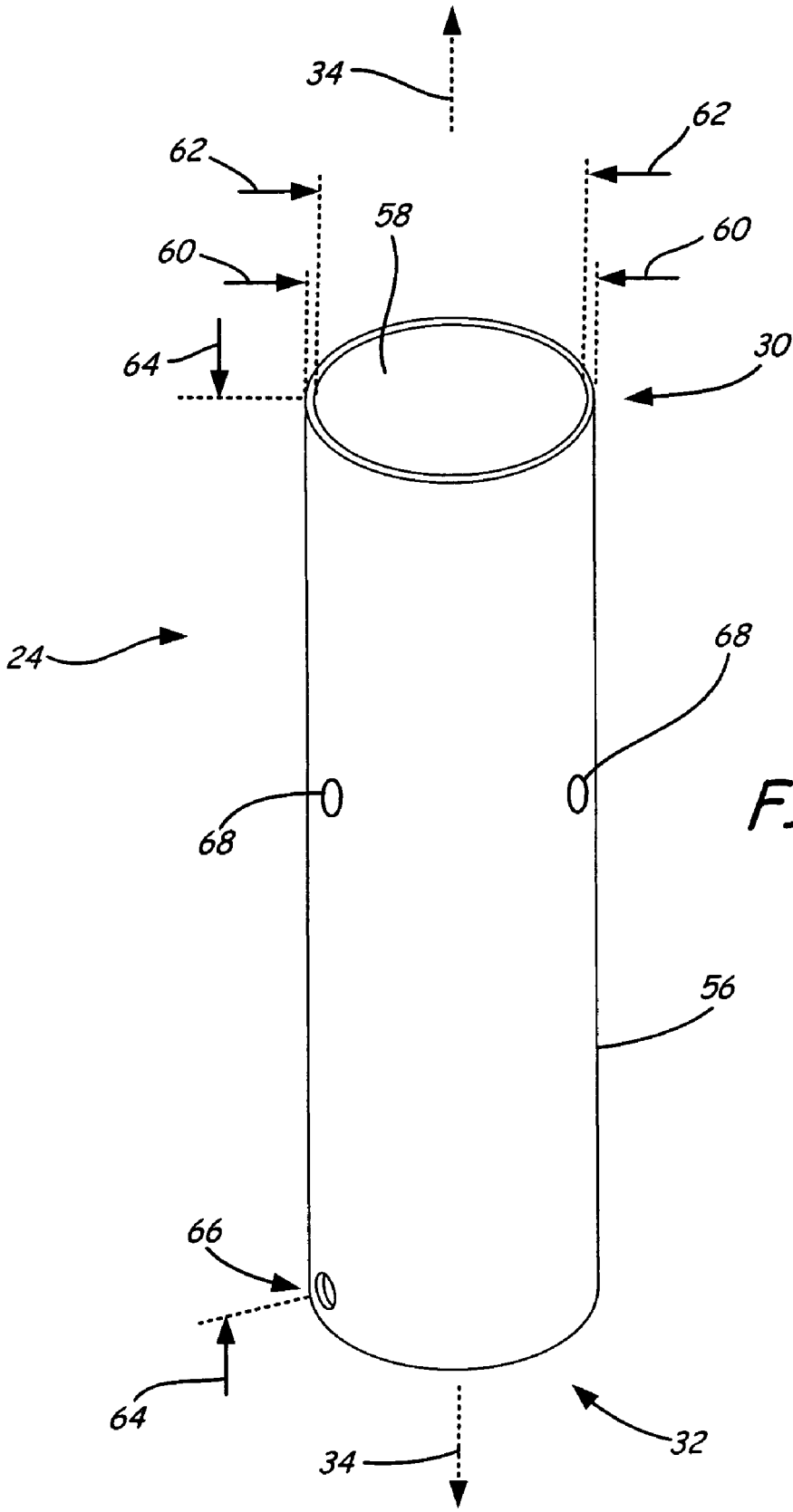
FIG. 5 is a perspective view of a tube of a base of the present invention.

FIG. 5 is a perspective view of the tube 24 of the base 22. The tube 24 includes an outer surface 56 and an inner surface 58, both extending circumferentially around the longitudinal axis 34, and defining an outer diameter 60 and an inner diameter 62, respectively.

Examples of a suitable value for outer diameter 60 range from about 1 to 5 inches, with a particularly suitable value for outer diameter 60 including about 3.1 inches. Examples of a suitable value for inner diameter 62 range from about 1 to 5 inches, with a particularly suitable value for inner diameter 62 including about 3.0 inches. The tube 24 also includes a length 64 extending along the longitudinal axis 34. Examples of a suitable value for length 64 range from about 6 to 16 inches, with a particularly suitable value for length 64 including about 11.0 inches.

The tube 24 also includes a pin hole 66 and bores 68. The pin hole 66 is an opening in the tube 24 for inserting and securing the pin 40 (not shown in FIG. 5; see FIG. 2) within the tube 24 generally at the second end 32. Bores 68 are also holes in the tube 24, and are used for securing the tube 24 to the collar 28 of the base 20, as discussed below.

Figure 6A:
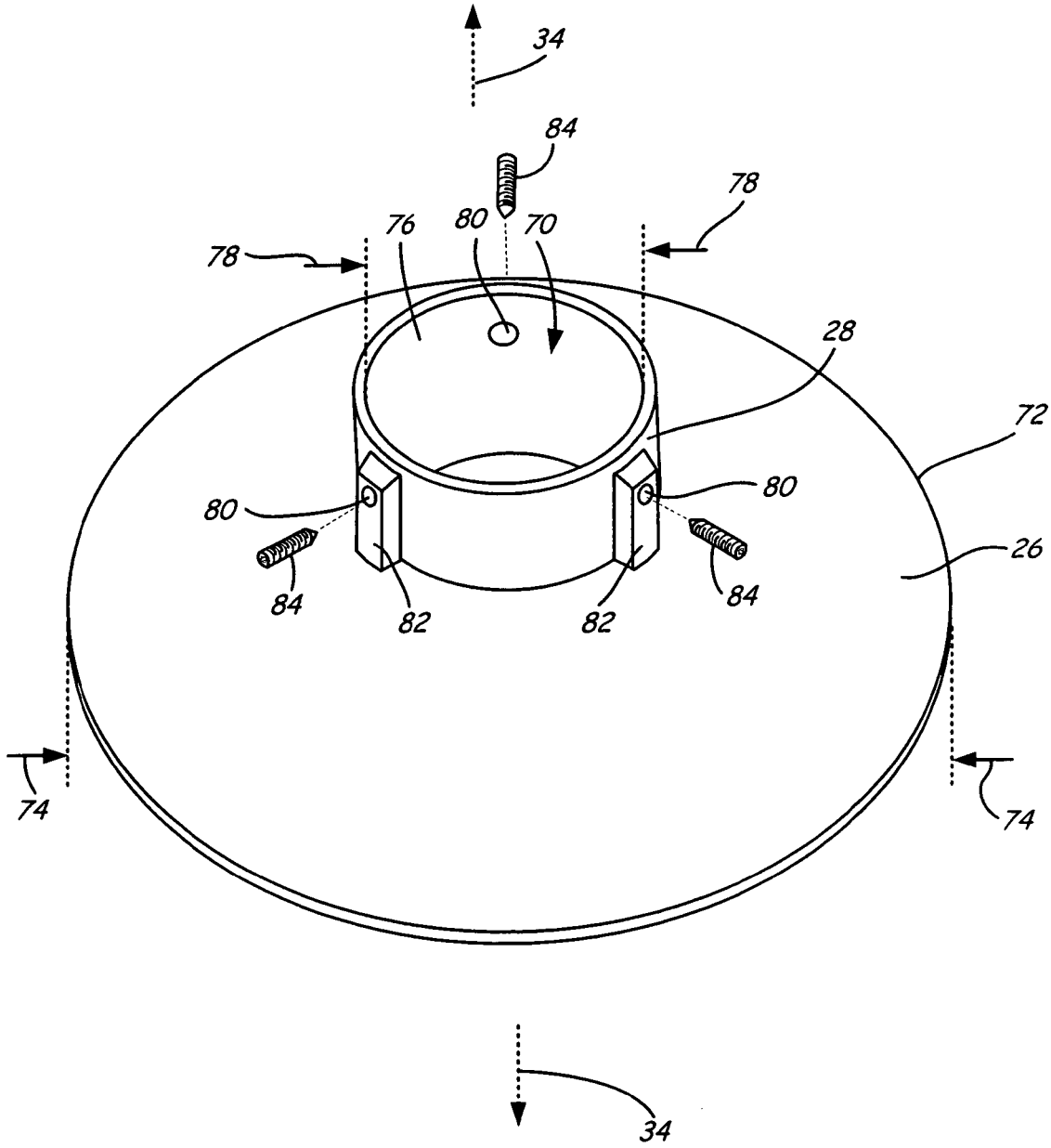
FIG. 6*a* is a top perspective view of a skirt and a collar of a base of the present invention.
Figure 6B:
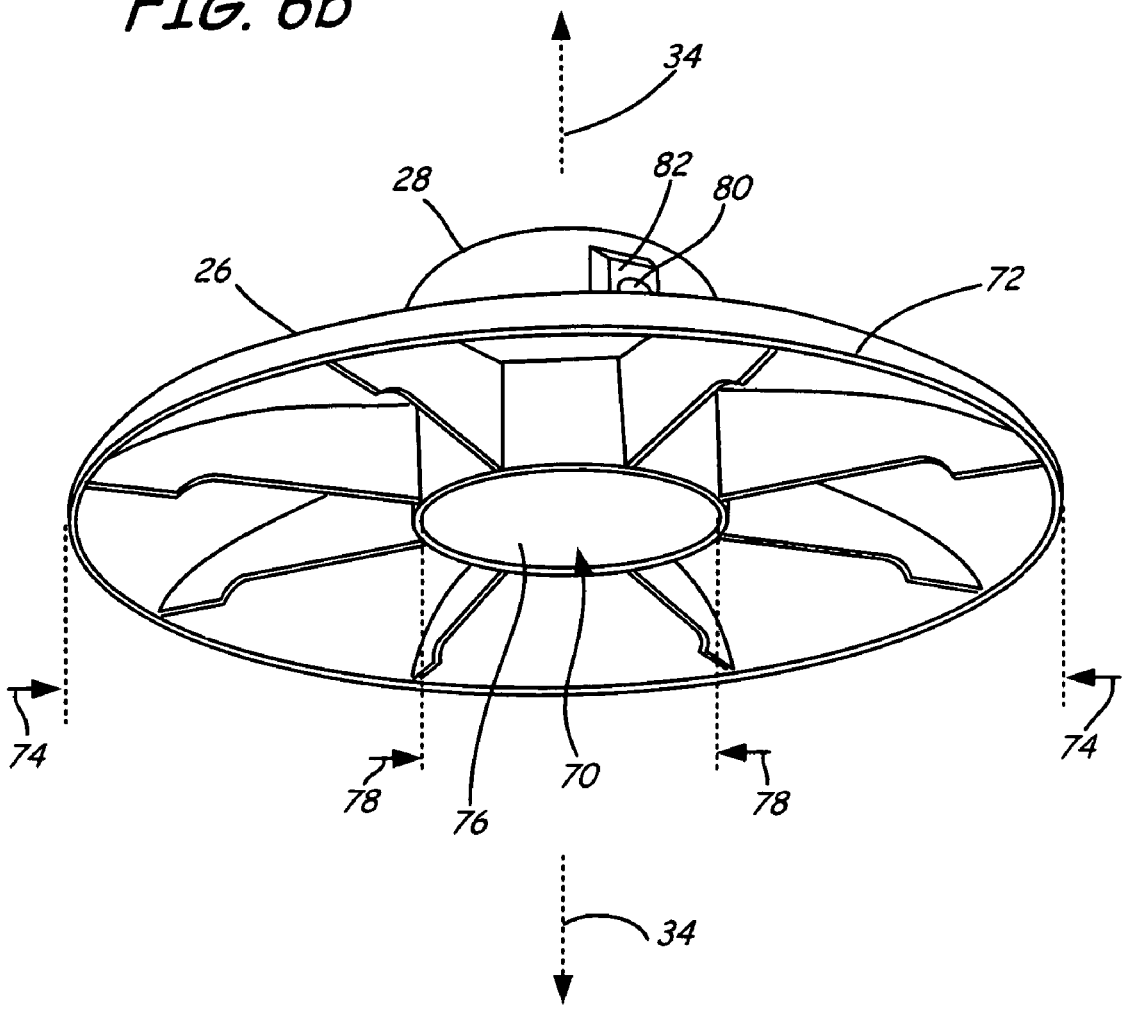
FIG. 6*b* is a bottom perspective view of a skirt and a collar of a base of the present invention.

FIGS. 6*a* and 6*b* are top and bottom perspective views, respectively, of the skirt 26 and the collar 28 of the base 20. The base 20 also includes a base annular passage 70. The skirt 26 is preferably a dome-shaped component which extends circumferentially around the base annular passage 70. The skirt 26 includes an outer edge 72, which defines an outer diameter 74. Examples of a suitable value for outer diameter 74 range from about 7 to 15 inches, with a particularly suitable value for outer diameter 74 including about 10.0 inches.

The collar 28 extends above the skirt 26 and circumferentially around the base annular passage 70. The collar 28 includes an inner surface 76, which defines an inner diameter 78. Examples of a suitable value for inner diameter 78 range from about 1 to 5 inches, with a particularly suitable value for inner diameter 78 including about 3.1 inches.

Preferably, the skirt 26 and the collar 28 are cast or molded from a die as a single component, but may alternatively be separate parts that are securely connected in a conventional manner (e.g. welding).

The collar 28 also includes bores 80, which are holes that extend through the collar 28, and are used for securing the tube 24 to the collar 28 to form the base 20. Bores 80 are each surrounded by extended bosses 82, which are integrally formed with the collar 28. As discussed below, fasteners 84 are inserted through the extended bosses 82 and bores 80 to secure the collar 28 to the tube 24.

When installing the umbrella support system 10, the tube 24 is inserted through the base annular passage 70, such that the skirt 26 and the collar 28 are vertically positioned between the first end 30 and the second end 32, and such that the bores 68 of the tube 24 and the bores 80 of the collar 28 are aligned. Fasteners 84 (e.g., screws, nails, and bolts) are then inserted through the extended bosses 82, the bores 80 of the collar 28, and the bores 68 of the tube 24, to securely connect the tube 24 and the collar 28 to form the base 20.

After the base 20 is formed, the second end 32 of the tube 24 is inserted through the receptacle annular passage 42 of the receptacle 22 until the skirt 26 rests on the mounting surface 14. Preferably, the dimensions of the receptacle 22 and the tube 24 are such that the tube 24 is removably insertable into the receptacle annular passage 42, and is also frictionally secured in the receptacle annular passage 42 so as to require a given amount of force to remove the tube 24 from the receptacle 22. This allows the umbrella support system 10 to provide lateral support for the umbrella 12. If the tube 24 were loosely inserted in the receptacle annular passage 42, the level of lateral support provided by the umbrella support system 10 would be reduced.

By allowing the base 20 to be removable from the receptacle 22, the umbrella support system 10 of the present invention provides several additional advantages. First, when not in use, the base 20 may be stored to prevent people from tripping over it. Accordingly, the only remaining portion of the umbrella support system 10 is the receptacle 22, which is generally flush with the mounting surface 14. As such, the umbrella support system 10 will not be a hazard for people walking over the area when the umbrella support system 10 is not in use.

Figure 7:
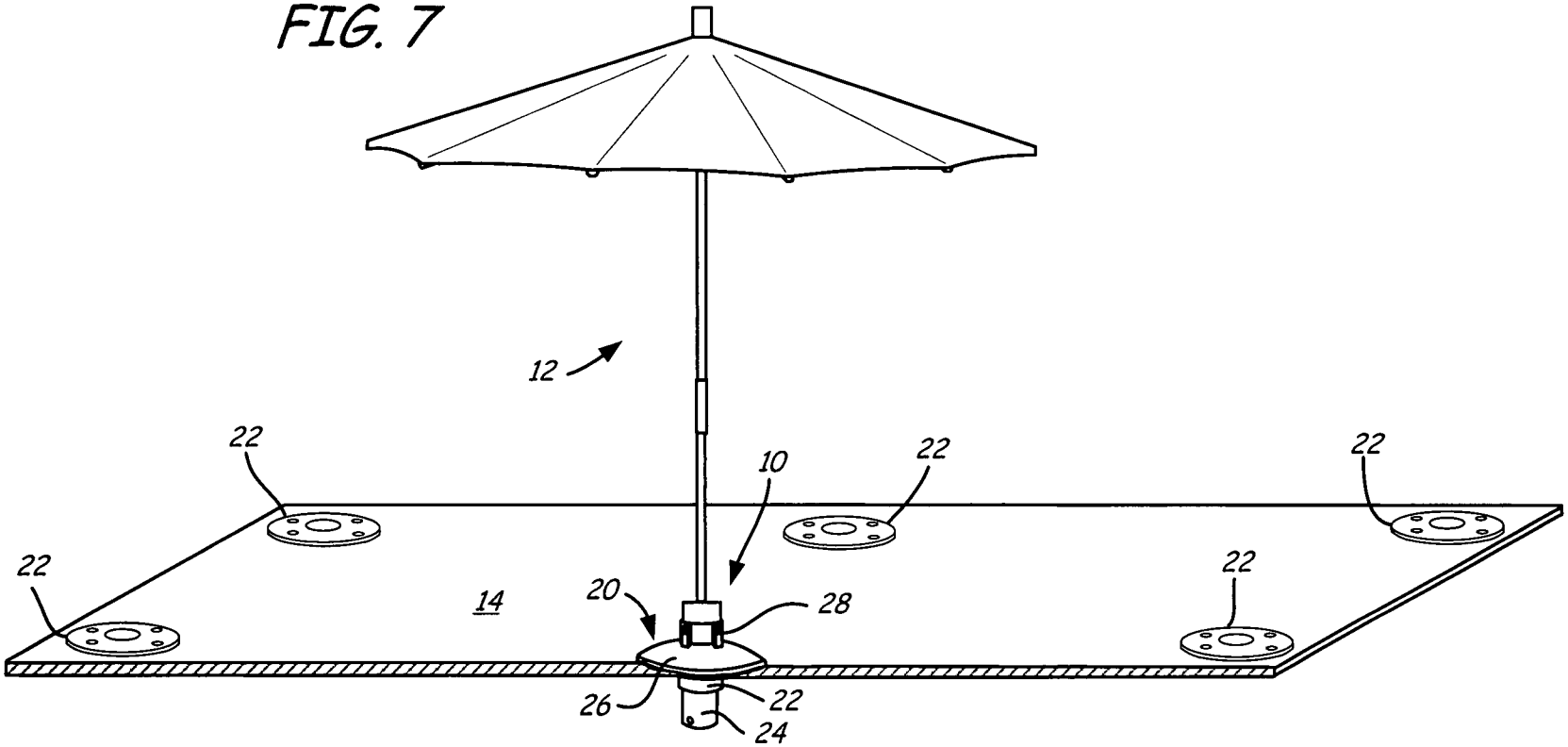
FIG. 7 is a perspective view of the present invention in use and having multiple receptacles mounted at various locations for use with a single base.

Additionally, a single base 20 may be used with multiple receptacles 22, which are placed at various desired mounting surfaces 14. FIG. 7 is a perspective view of umbrella 12 inserted into umbrella support system 10, similar to FIG. 1. However, in FIG. 7, multiple receptacles 22 are shown mounted to surface 14, and base 20 is interchangeable with any of receptacles 22. With multiple receptacles 22, the umbrella support system 10 may be placed in multiple locations as the position of the sun changes, or as a user moves to a different location, such as from the boat to the deck. This increases the versatility of the umbrella support system 10.

After the umbrella support system 10 is installed, the shaft 16 of the umbrella 12 is then inserted into the tube 24 of the base 20 until the pin 40 is reached. Preferably, the shaft 16 exhibits a diameter that allows the shaft 16 to be readily inserted into the tube 24, and also allows the shaft 16 to be frictionally secured in the tube 24. This prevents the umbrella 12 from accidentally dislodging from the umbrella support system 10 and allows the umbrella support system 10 to provide lateral support to the umbrella 12. In addition, the tube 24 may include a thumb screw (not shown) that can be used to tighten the shaft 16 after it is inserted into the tube 24. Alternatively, if the diameter of the shaft 16 is too narrow for the tube 24, conventional objects may be inserted into the tube 24 or wrapped around the shaft 16 to modify the diameter of the shaft 16 and/or the inner diameter 62 of the tube 24.

The collar 28 of the base 20 and the sleeve 38 of the receptacle 22 support the tube 24 in the vertical direction. This provides the lateral support of the umbrella support system 10. When lateral force is applied to the shaft 16 of the umbrella 12, a portion of the lateral force is correspondingly transferred to the tube 24 extending around the shaft 16. In a conventional umbrella stand, such as a weighted base, the transferred lateral force would then directly affect the conventional umbrella stand. If the lateral force is great enough, the conventional umbrella stand may tip over or be moved laterally itself.

However, the sleeve 38 of the receptacle 22, which is securely mounted to the mounting surface 14 via the flange 36, extends downward in the vertical direction, circumferentially around the tube 24. This locks the tube 24 to the mounting surface 14 and transfers a portion of the lateral force to the receptacle 22. Moreover, the collar 28 of the base 20 is securely connected to the tube 24 via fasteners 84, and extends vertically upward in the vertical direction, circumferentially around the tube 24. As such, a portion of the lateral force applied to the tube 24 is also transferred to the collar 28. This force is then transferred from the collar 28 to the skirt 26, and correspondingly to the mounting surface 14. As such, the umbrella support system 10 provides stable, lateral support to the umbrella 12, and allows the umbrella 12 to be used in a variety of conditions where conventionally supported umbrellas would tip over and/or break.

The umbrella support system 10 may be formed from a variety of rigid materials, such as metals, plastics, ceramics, wood, and combinations thereof. Preferred materials for the umbrella support system 10 include metals and plastics (e.g., polycarbonate). Preferably, the materials used are capable of withstanding significant levels of force without breaking. Additionally, the materials are preferably rust, heat, and corrosion resistant, and/or are protected from rust, heat, and corrosion. This allows the umbrella support system 10 to be used in hot maritime environments without being significantly damaged.

Although the present invention has been described with reference to preferred embodiments, workers skilled in the art will recognize that changes may be made in form and detail without departing from the spirit and scope of the invention.

The invention claimed is:

1. A support system for supporting umbrella, comprising:

a receptacle mountable in a hole extending through a deck having a top surface and a bottom surface, the receptacle comprising:

a flange configured to be mounted to the deck such that the flange is generally flush with the top surface; and an annular passage in a center of the flange; and a base for providing lateral support to a mountable object, the base comprising:

a skirt; and a tube for retaining the mountable object, wherein the tube extends through the skirt, and the annular passage, such that the tube is retained in the receptacle, wherein the tube has a first end and a second end, the second end including a retention means for retaining a bottom tip of an object inserted into the tube and for allowing water to pass through the second end of the tube.

2. The support system of claim 1, wherein the base further comprises a collar that extends in a direction substantially normal to the skirt, wherein the tube further extends through the collar.

3. The support system of claim 1, wherein the tube is removably retained in the receptacle.

4. The support system of claim 1, wherein the receptacle further comprises:

a sleeve that extends in a direction substantially normal to the flange, wherein the sleeve is configured to reside below the top surface and retain the tube.

5. The support system of claim 1, wherein the annular passage of the receptacle has a passage diameter, and the tube has an outer diameter about equal to the passage diameter.

6. The support system of claim 1, wherein the retention means comprises a pin that extends diametrically within the second end of the tube.

7. A support system comprising:

a plurality of receptacles mountable to a plurality of surfaces, each surface having a top surface and a bottom surface, and each receptacle comprising:

a flange configured to be mounted to the top surface such that the flange is generally flush with the top surface; and a sleeve extending from the flange in a direction substantially normal to the flange such that the sleeve is configured to reside below the bottom surface; and an umbrella support base engageable with each of the receptacles and configured to provide lateral support to an umbrella, the umbrella support base comprising:

a tube having a first end and a second end, and configured to retain the umbrella, wherein the tube is insertable into the sleeve of the receptacle such that the second end of the tube extends below the sleeve;

a pin inserted diametrically across the second end of the tube to support a lower end of the umbrella in the tube;

a skirt that extends circumferentially around the tube such that the first end of the tube extends above the skirt; and a collar that extends circumferentially around the tube, wherein the collar also extends above the top surface in a direction substantially normal to the skirt, and the first end of the tube extends above the collar.

8. The support system of claim 7, wherein the umbrella support base further comprises an annular passage and the tube is extendable through the annular passage.

9. A support system comprising:

a plurality of bases lateral support to an umbrella, the base comprising:

a tube for retaining the umbrella;

a skirt that extends circumferentially around the tube; and a collar that extends circumferentially around the tube, wherein the collar also extends upwards in a direction substantially normal to the skirt; and a plurality of receptacles, each receptacle being capable of removably retaining in each base and comprising:

a flange configured to be mounted to a surface such that the flange is generally flush with the surface; and a sleeve that extends in a direction substantially normal to the flange and is configured to reside below the surface, wherein the tube is configured to extend through the sleeve such that the sleeve provides lateral support to the tube and the umbrella.

10. The support system of claim 9, wherein the base comprises a first passage and the sleeve of the receptacle comprises a second passage, and the tube extends through the first passage and is removably insertable through the second passage.

11. The support system of claim 10, wherein the first passage and the second passage each exhibit a cross-sectional dimension that is annular.

12. The support system of claim 9, wherein the skirt is dome-shaped.

13. A support system for supporting umbrella, comprising:

a plurality of receptacles mountable to a surface and comprising:

a flange configured to be mounted to the surface such that the flange is generally flush with the surface; and an annular passage in a center of the flange; and a plurality of bases for providing lateral support to a mountable object, the base comprising:

a skirt; and a tube for retaining the mountable object, wherein the tube extends through the skirt, and the annular passage, such that the tube is retained in the receptacle, wherein the tube has a first end and a second end, the second end including a retention means for retaining a bottom tip of an object inserted into the tube and for allowing water to pass through the second end of the tube;

wherein each base is removably engageable with each of the receptacles.

14. A support system comprising:

a base for providing lateral support to an umbrella, the base comprising:

a tube for retaining the umbrella;

a skirt that extends circumferentially around the tube; and a collar that extends circumferentially around the tube, wherein the collar also extends in a direction substantially normal to the skirt; and a receptacle for removably retaining the base, the receptacle comprising:

a flange configured to be mounted to a surface such that the flange is generally flush with the surface; and a sleeve that extends in a direction substantially normal to the flange and is configured to reside below the surface, wherein the tube is configured to extend through the sleeve such that the sleeve provides lateral support to the tube and the umbrella;

wherein the skirt substantially covers the flange when the base is retained within the receptacle.

* * * * *